US008056747B2

(12) United States Patent
Vitan et al.

(10) Patent No.: US 8,056,747 B2
(45) Date of Patent: Nov. 15, 2011

(54) REMOVABLE TANK FOR LAUNDRY BULK DISPENSER SYSTEM

(75) Inventors: Craig Robert Vitan, Louisville, KY (US); John Michael Todd, Louisville, KY (US); Craig Richard Dressler, Louisville, KY (US); Lee Andrew Fain, Louisville, KY (US); Bhawesh Kumar Choursiya, Andhra Pradesh (IN); Keerthi Vasan, Andhra Pradesh (IN); Kannan Krishnan, Andhra Pradesh (IN); Madhusudhanan Mani, Andhra Pradesh (IN); Sivaprasad Polimetla, Andhra Pradesh (IN); Venkat Kakileti, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 42 days.

(21) Appl. No.: 11/871,783

(22) Filed: Oct. 12, 2007

(65) Prior Publication Data

US 2009/0095750 A1 Apr. 16, 2009

(51) Int. Cl.
*D06F 37/00* (2006.01)

(52) U.S. Cl. ..... 220/23.83; 68/17 R; 68/207; 206/459.1

(58) Field of Classification Search ..... 68/17 R, 68/207; 206/459.1; 220/23.83
See application file for complete search history.

(56) References Cited

U.S. PATENT DOCUMENTS

| | | | | |
|---|---|---|---|---|
| 2,699,886 | A | 1/1955 | James | |
| 2,946,489 | A | 7/1960 | Brucken | |
| 3,013,568 | A | 12/1961 | Getchell et al. | |
| 3,045,876 | A | 7/1962 | Marchi | 222/386 |
| 3,107,824 | A | 10/1963 | Perl | |
| 3,124,271 | A | 3/1964 | Beck | 222/644 |
| 3,289,896 | A | 12/1966 | Cushing | |
| 3,402,853 | A | 9/1968 | Perl | |
| 3,595,036 | A | 7/1971 | DePas | |
| 3,608,514 | A | 9/1971 | Dunn | |
| 3,826,113 | A | 7/1974 | Boraas et al. | |
| 3,827,600 | A | 8/1974 | Janke | |
| 3,856,058 | A | 12/1974 | Fackler | |
| 3,896,827 | A | 7/1975 | Robinson | |
| 4,009,598 | A | 3/1977 | Bernard et al. | |
| 4,063,663 | A | 12/1977 | Larson et al. | |
| 4,149,654 | A | 4/1979 | Nelson et al. | |

(Continued)

FOREIGN PATENT DOCUMENTS

DE 24 07 544 8/1975

(Continued)

OTHER PUBLICATIONS

European Patent Office 0 430 366 Jun. 1991.

(Continued)

*Primary Examiner* — Anthony Stashick
*Assistant Examiner* — Elizabeth Volz
(74) *Attorney, Agent, or Firm* — Merchant & Gould

(57) ABSTRACT

Systems and methods for providing removable storage tanks in an appliance having a pedestal are disclosed. The systems include a storage container located in the pedestal and configured to house an additive. In addition, a cover may be positioned within the pedestal to secure the container within the pedestal. The methods include manufacturing the pedestal such that when a storage container is placed in the pedestal, the storage container will fit in a predetermined orientation. The storage container may be manufactured such that when the storage container is placed in the pedestal the storage container can be secured in the pedestal with a cover.

10 Claims, 3 Drawing Sheets

U.S. PATENT DOCUMENTS

| | | | | |
|---|---|---|---|---|
| 4,149,657 | A | 4/1979 | Nelson et al. | |
| RE30,097 | E | 9/1979 | Gillespie | 68/12.08 |
| 4,213,338 | A | 7/1980 | Hardy | |
| 4,334,881 | A | 6/1982 | Reinert et al. | |
| 4,373,863 | A | 2/1983 | Mason et al. | |
| 4,488,666 | A | 12/1984 | Herbst et al. | |
| 4,756,321 | A | 7/1988 | Livingston et al. | |
| 4,830,509 | A | 5/1989 | Gulmatico, Jr. | |
| 4,845,965 | A | 7/1989 | Copeland et al. | |
| 4,932,227 | A | 6/1990 | Hogrefe | |
| 5,033,659 | A | 7/1991 | Marks et al. | |
| 5,133,487 | A | 7/1992 | Russi | |
| 5,144,819 | A | 9/1992 | Hiyama et al. | 68/12.04 |
| 5,211,188 | A | 5/1993 | Kraus | |
| 5,241,845 | A | 9/1993 | Ishibashi et al. | 68/12.02 |
| 5,390,385 | A | 2/1995 | Beldham | |
| 5,392,618 | A | 2/1995 | Livingston et al. | |
| 5,435,157 | A | 7/1995 | Laughlin | |
| 5,560,060 | A | 10/1996 | Dausch et al. | |
| 5,603,233 | A | 2/1997 | Erickson et al. | |
| 5,647,391 | A | 7/1997 | Chan et al. | |
| 5,743,442 | A | 4/1998 | Barbe | |
| 5,758,521 | A | 6/1998 | Roberts | |
| 5,782,109 | A | 7/1998 | Spriggs et al. | |
| 5,823,390 | A | 10/1998 | Muderlak et al. | |
| 5,884,808 | A | 3/1999 | Muderlak et al. | |
| 6,012,613 | A | 1/2000 | Chen | |
| 6,095,370 | A | 8/2000 | Rhine et al. | |
| 6,152,327 | A | 11/2000 | Rhine et al. | |
| 6,293,428 | B1 | 9/2001 | Chen | |
| 6,338,351 | B1 | 1/2002 | Schrott | |
| 6,401,499 | B1 | 6/2002 | Clark et al. | |
| 6,434,977 | B1 * | 8/2002 | Hapke et al. | 68/17 R |
| 6,453,917 | B1 | 9/2002 | Biechele | |
| 6,463,611 | B1 | 10/2002 | Mattla et al. | |
| 6,616,401 | B2 | 9/2003 | Nakamura | |
| 6,669,052 | B2 | 12/2003 | Barbe | |
| 6,733,252 | B2 | 5/2004 | Feygin et al. | |
| 6,792,637 | B2 * | 9/2004 | Reichold et al. | 8/159 |
| 7,658,088 | B2 * | 2/2010 | Walker et al. | 68/17 R |
| 7,802,335 | B2 | 9/2010 | Hoppe et al. | |
| 2002/0088502 | A1 | 7/2002 | Van Rompuy et al. | |
| 2002/0117187 | A1 | 8/2002 | Helminger | |
| 2002/0153029 | A1 | 10/2002 | Cerruti et al. | |
| 2003/0127110 | A1 | 7/2003 | Reichold et al. | |
| 2003/0137264 | A1 | 7/2003 | Peterson et al. | |
| 2004/0020517 | A1 | 2/2004 | Cerruti et al. | |
| 2004/0093913 | A1 * | 5/2004 | Bolduan et al. | 68/17 R |
| 2004/0226961 | A1 | 11/2004 | Mehus et al. | |
| 2004/0245284 | A1 | 12/2004 | Mehus et al. | |
| 2005/0241347 | A1 * | 11/2005 | Cho et al. | 68/243 |
| 2006/0117811 | A1 | 6/2006 | Kinnetz | |
| 2008/0104768 | A1 | 5/2008 | Choi | 8/147 |
| 2008/0276965 | A1 | 11/2008 | Aykroyd et al. | 134/18 |
| 2009/0095028 | A1 | 4/2009 | Hoppe et al. | |
| 2009/0095331 | A1 | 4/2009 | Hoppe | |

FOREIGN PATENT DOCUMENTS

| | | | |
|---|---|---|---|
| DE | 34 42 194 | | 5/1986 |
| DE | 40 00 378 | | 7/1991 |
| DE | 20302572 | | 4/2003 |
| EP | 0 633 342 | | 1/1995 |
| EP | 0 860 141 | A2 | 8/1998 |
| EP | 0726 978 | B1 | 9/1998 |
| GB | 2214524 | | 6/1989 |
| JP | 60-034493 | | 2/1985 |
| JP | 62-284696 | | 12/1987 |
| JP | 01-178294 | | 7/1989 |
| JP | 02-104393 | | 4/1990 |
| JP | 04-187183 | | 7/1992 |
| JP | 06-233894 | | 8/1994 |
| JP | 07-108095 | | 4/1995 |
| JP | 2001157795 | | 12/2000 |
| JP | 2003-326076 | | 11/2003 |
| KR | 2005-066520 | | 6/2005 |

OTHER PUBLICATIONS

Official Office Action mailed Jan. 12, 2010, in U.S. Appl. No. 11/871,750, pp. 1-10.

U.S. Official Action mailed Apr. 22, 2010 in U.S. Appl. No. 11/871,726, pp. 1-16.

U.S. Official Action mailed Sep. 3, 2010 in U.S. Appl. No. 11/871,726, pp. 1-9.

U.S. Official Action mailed Dec. 29, 2010 in U.S. Appl. No. 11/871,726, pp. 1-9.

U.S. Official Action mailed May 17, 2011 in U.S. Appl. No. 11/871,726, pp. 1-13.

* cited by examiner

REMOVABLE TANK FOR LAUNDRY BULK DISPENSER SYSTEM

CROSS-REFERENCE TO RELATED APPLICATIONS

The present application is related to U.S. patent application having Ser. No. 11/871,726 titled "Multiple Compartments Wash Additives Auto-Dispenser in Washer or Dryer Pedestal" filed Oct. 12, 2007 having and U.S. patent application having Ser. No. 11/871,750 titled "Bulk Dispense User Adjustable Controls" filed Oct. 12, 2007 which are hereby incorporated by reference in their entirety.

FIELD OF INVENTION

Embodiments of the present invention generally relate to additive storage. More specifically, embodiments of the present invention relate to systems and methods for storage tanks locatable within a pedestal located beneath an appliance for use with an automatic dispensing system that houses additive in volumes greater than the amounts required for a single wash cycle.

BACKGROUND OF THE INVENTION

Current systems for adding additives (e.g. soap, fabric softener, etc.) to an appliance (e.g. washing machine, dryer, etc.) utilize pumps to force air into a container housing the additive thereby increasing the pressure within the container, use a gravity feed to deliver the additive to the appliance, or use positive displacement pumps to draw the additive from either a rigid or flexible container. Currently, the containers are located inside an appliance cabinet and are not accessible to a user without disassembling the appliance, or are separated from the appliance and taking up additional floor and wall space. For example, if the internal container develops a leak, a homeowner or service person would be required to disassemble the washing machine to replace or repair the container.

Having the containers and other hardware (e.g. pumps, circuitry, and other connections) located inside the appliance cabinet also hinders routine maintenance such as cleaning the containers. In addition, having the containers located inside the appliance cabinet does not allow a user to alter the additive capacity. For example, the homeowner may want to load two gallons of soap and a half a gallon of fabric softener, but if the appliance only has two one-gallon containers, then the homeowner's wishes cannot be accommodated.

Having the above problems in mind, there exist a need for systems and methods for having removable storage tanks that occupy minimal additional space for use in delivering additives to appliances. The systems and methods should facilitate easy access to the containers, and customization based on user preferences, and easy maintenance.

BRIEF DESCRIPTION OF THE INVENTION

Consistent with embodiments of the present invention, systems for providing removable storage tanks in an appliance having a pedestal are disclosed. The systems include a storage container located in the pedestal and configured to house an additive. In addition, a cover may be positioned within the pedestal to secure the container within the pedestal.

Still consistent with embodiments of the present invention, methods for providing removable storage tanks in an appliance having a pedestal may include manufacturing the pedestal such that when a storage container is placed in the pedestal, the storage container will fit in a predetermined orientation. The storage container may be manufactured such that when the storage container is placed in the pedestal the storage container may be secured in the pedestal with a cover.

BRIEF DESCRIPTION OF THE FIGURES

Non-limiting and non-exhaustive embodiments are described with reference to the following figures, wherein like reference numerals refer to like parts throughout the various views unless otherwise specified.

GENERAL DESCRIPTION

Reference may be made throughout this specification to "one embodiment," "an embodiment," "embodiments," "an aspect," or "aspects" meaning that a particular described feature, structure, or characteristic may be included in at least one embodiment of the present invention. Thus, usage of such phrases may refer to more than just one embodiment or aspect. In addition, the described features, structures, or characteristics may be combined in any suitable manner in one or more embodiments or aspects. Furthermore, reference to a single item may mean a single item or a plurality of items, just as reference to a plurality of items may mean a single item. Throughout this specification a washing machine or a dryer may be used as an example appliance. Moreover, use of the term "and" when incorporated into a list is intended to imply that all the elements of the list, a single item of the list, or any combination of items in the list has been contemplated. It is contemplated that embodiments of the invention may be used with other appliances such as a dishwasher, refrigerator, trash compactor, ice machine, etc.

Embodiments of the present invention utilize at least one removable storage container that may be located within a pedestal situated beneath an appliance (e.g. washing machine, dryer, dishwasher, etc.). The removable storage container may house an additive to be delivered to the appliance.

Other aspects of the invention may include having sensors to monitor the amount of additives stored in the removable storage container. The removable storage container may be configured such that they may only be installed in the pedestal in a predetermined manner or may be secured in childproof manners. In addition, various embodiment of the invention may include sensors to alert a user to leaks within the system, low levels of additives or other maintenance/service related issues.

DETAILED DESCRIPTION

Figure 1:
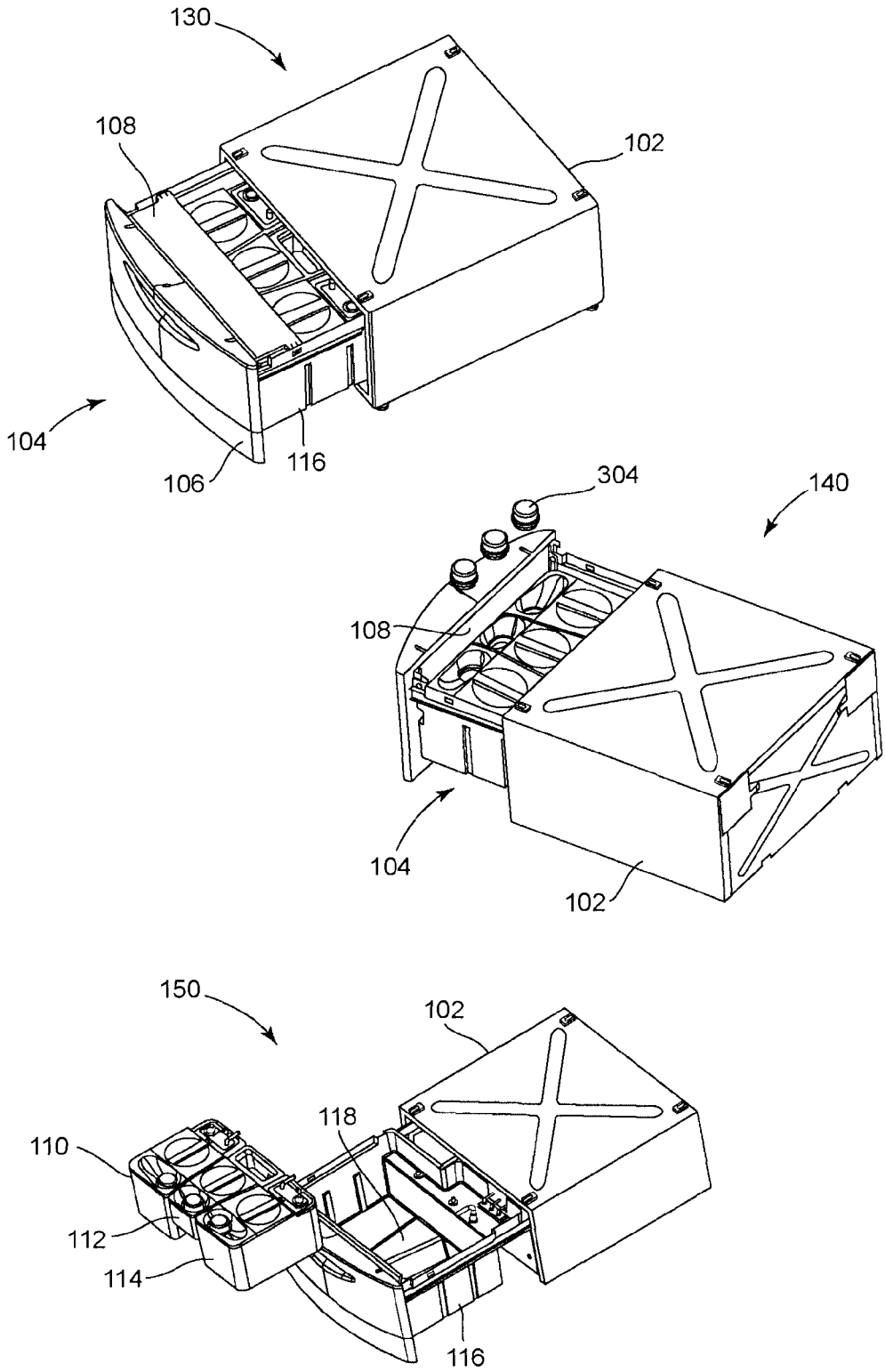
FIG. 1 depicts a process of removing storage tanks from a pedestal.

Referring now to the figures, FIG. 1 depicts a process of removing storage tanks from a pedestal. In stage 130, drawer 104 may be extended from pedestal 102 by pulling on pedestal face 106. Extending drawer 104 from pedestal 102 may expose a cover 108. Cover 108 may be attached directly to drawer 104 or to a tub 116 located in drawer 104.

In stage 140, cover 108 may be removed exposing caps 304. While cover 108 as illustrated is pivotally attached to drawer 104, it is contemplated that cover 108 may be completely removable or attached so as to pivot in other fashions.

Caps 304 may be removed from removable storage tanks 110, 112, and 114 in order to illustrate the contents of removable storage tanks 110, 112, and 114 as well as allow a user to refill removable storage tanks 110, 112, and 114.

In stage 150, removable storage tanks 110, 112, and 114 may be removed from pedestal 102. Removing removable storage tanks 110, 112, and 114 may facilitate maintenance and replacement of removable storage tanks 110, 112, and 114. Removable storage tanks 110, 112, and 114 may be removed independently of one another. For example, storage tank 110 may be removed without the removal of storage tanks 112 and 114.

While drawer 104 has been described as a "sliding drawer," it is contemplated that drawer 104 may be stationary and a pedestal face 106 may be operatively hinged to tub 116. For example, pedestal face 106 may be operatively hinged to tub 116 to allow access to removable storage tanks 110, 112, and 114.

Figure 2:
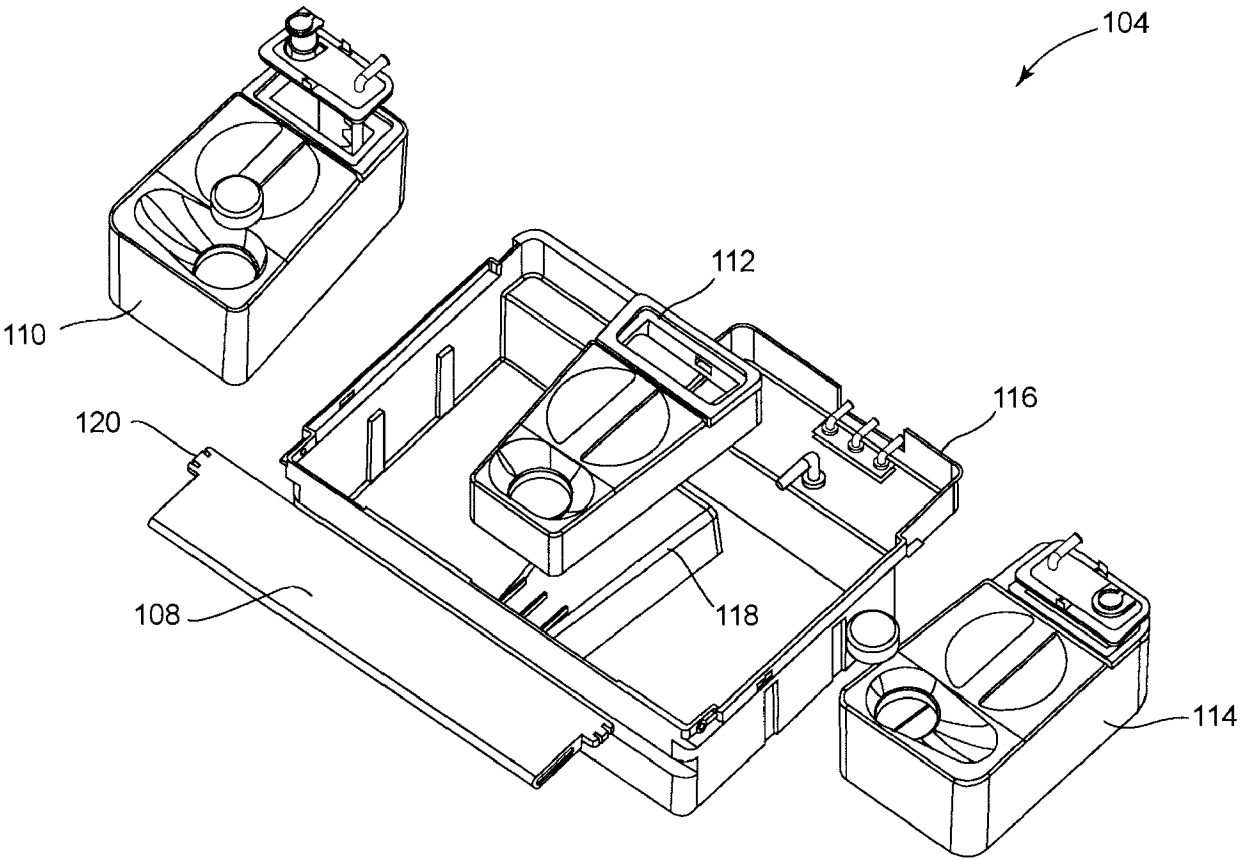
FIG. 2 depicts an exploded assembly of removable storage tanks configured to be secured in a tub.

Referring now to the FIG. 2, FIG. 2 depicts an exploded assembly of removable storage tanks 110, 112, and 114 configured to be secured in tub 116. As shown in FIG. 2, removable storage tanks 110, 112, and 114 may be keyed to tub 116. Keying removable storage tanks 110, 112, and 114 may entail configuring removable storage tanks 110, 112, and 114 such that they may be able to fit within tub 116 in a single orientation and configuration, such as having them be differing shapes (e.g. differing heights, widths, depths, rectangular, and spherical) such that the differing shapes designate a particular location for each of removable storage containers 110, 112, and 114. For example, in one embodiment, removable storage tank 112 may be shorter than removable storage tanks 110 and 114. Therefore, indentation 118 prevents removable storage tanks 110 and 114 from being installed in the center position. In addition, the shape of removable storage tanks 110 and 114 in conjunction with the shape of indentation 118 prevents removable storage tank 110 from being installed in the position intended for removable storage tank 114.

Furthermore, the tanks' shape may interact with each other in a way that prohibits removable storage tanks 110, 112, and 114 from being installed in an incorrect orientation without relying on the design of pedestal 102, drawer 104, and tub 116. For example, removable storage tanks 110, 112, and 114 may act as a puzzle between one another such that removable storage tanks 110, 112, and 114 have a predetermined orientation or manner of use established by the shape of removable storage tanks 110, 112, and 114.

Tub 116 may be manufactured and configured such that removable storage tanks 110, 112, and 114 may only be installed in tub 116 in a predetermined fashion. For example, removable storage tanks 110, 112, and 114 may be manufactured of varying shapes and sizes and tub 116 may be configured such that removable storage tanks 110, 112, and 114 can be positioned in tub 116 in a predetermined manner. As show in FIG. 2, tub 116 may be configured to contain an indentation 118 such that removable storage tanks 110, 112, and 114 may only fit in one way. In addition, removable storage tank 112 may not be the same size as tanks 110 and 114. In one embodiment, removable storage tank 112 may be a half-gallon container, as indicated by its size, and removable storage tanks 110 and 114 may be a one-gallon containers, as indicated by their size.

Having removable storage tanks of various shapes may be used to indicate the additive contained in the removable storage tank. For example, removable storage tank 112 may contain fabric softener and removable storage tanks 110 and 114 may contain the same or different detergents.

In addition, removable storage tanks 110, 112, and 114 may be disposable. Alternatively, removable storage tanks 110, 112, and 114 may also be refillable (i.e., new additives may be added without removing removable storage tanks 110, 112, and 114 from drawer 104). It is contemplated however, that removable storage tanks 110, 112, and 114 may be removable, refillable, disposable, and washable. For example, removable storage tank 114 may be removed periodically by the user and washed. After a certain time or if removable storage tanks 110, 112, and 114 become damaged, removable storage tanks 110, 112, and 114 may be replaced.

Cover 108 may be used to secure removable storage tanks 110, 112, and 114 into tub 116 or pedestal 102. Cover 108 may include a securing feature 120 used to secure cover 108 in place. For example, securing feature 120 may be a spring loaded clip, a plastic clip, a pin, or other configurations that may be used to secure cover 108 in place. In addition, cover 108 may be configured to facilitate complete detachment of cover 108 from tub 116 or pedestal 102.

Cover 108 may also be configured to include "childproof" or "child safety" features. Cover 108 being configured such that it includes childproof features is a configuration that would hinder the removal of removable storage tanks 110, 112, and 114 or the exposure of caps 304 to the point that a child would have difficulty accessing caps 304 or removing removable storage tanks 110, 112, and 114. For example, securing feature 120 may be one or more spring loaded clips wherein compression of the spring loaded clip requires a force or distance between clips most children cannot overcome. In addition, the childproof feature may be incorporated in the caps themselves.

In addition, tub 116 may include various piping manifolds or other hardware necessary in order to connect removable storage tanks 110, 112, and 114 to one or more positive displacement pumps (e.g. peristaltic pumps) or the appliance. For example, if a single pump is connected to removable storage tanks 110, 112, and 114, a manifold utilizing valves (e.g. solenoid valves, etc.) may be needed to facilitate delivery of an additive from removable storage tank 110 to the washing machine without delivering an additive from removable storage tanks 112 and 114. In addition, the manifold may be configured to deliver two or more additives via a single pump. Furthermore, a plurality of pumps can be enclosed in a single removable, serviceable, protective housing.

Figure 3:
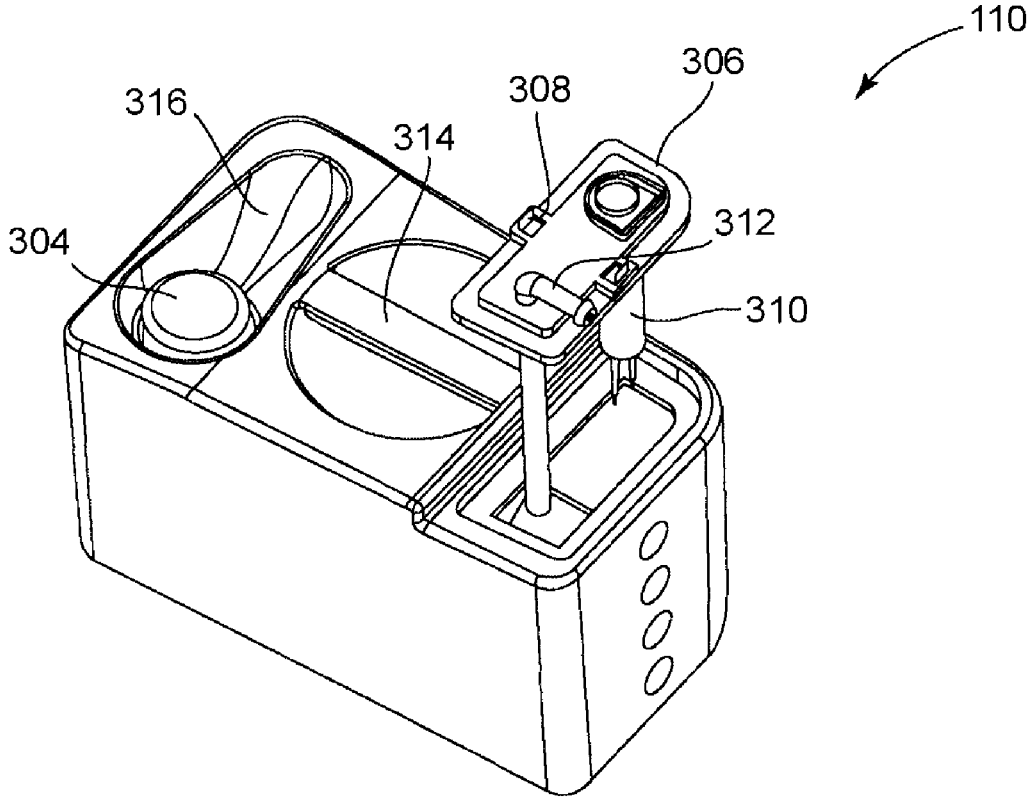
FIG. 3 depicts a removable storage tank.

Turning now to FIG. 3, FIG. 3 depicts removable storage tank 110. Removable storage tank 110 may include a cap 304, a sensor housing 306, a handle 314, and a built in funnel 316. Features such as handle 314 and the built in funnel 316 may be molded into removable storage tank 110. While FIG. 3, shows handle 314 as integrated into removable storage tank 110, handle 314 may be a separate part as well. In addition, removable storage tank 110 may be transparent. Viewing additive level or checking for additive clogging within removable storage tank 110 may be facilitated if removable storage tank 110 is transparent.

Sensor housing 306 may be a molded into removable storage tank 110 or, as shown, may be a removable fixture. Sensor housing 306 houses a sensor 310. Sensor 310 may be used to indicate the additive amount remaining in removable storage tank 110. Sensor housing 306 may be removable from removable storage tank 110. Removing sensor housing 306 may facilitate removing sensor 310. Removing sensor 310 may be necessary to perform maintenance such as cleaning or replacing sensor 310. Sensor housing 306 may contain clips 308. Clips 308 may be childproof and/or used to securely fasten sensor housing 306 to removable storage tank 110.

In addition, sensor housing 306 may be permanently connected to tub 116, pedestal 102, or appliance via fitting 312. Sensor housing 306 may be operatively used in conjunction with disposable removable storage tanks. For example, removable storage tank 110 may be a one-time use tank. A consumer may purchase detergent in a one-time use tank. The consumer may remove a portion of the one-time use tank such that sensor housing 306 may be inserted. Once the contents of the one-time use tank are depleted, the consumer simply replaces the one-time use tank.

During operation of a washing machine a user may select a predetermined mode. This predetermined mode may, for example, consist of washing whites, darks, delicates, full loads or fractional loads, amongst other options. When selecting this particular mode, the user may press a button on a washing machine controller. Upon pressing the button on the washing machine controller, a pump may add detergent from removable storage tank 110. Additionally, the washing machine controller may be programmed with various modes. For example, the washing machine controller may be programmed such that during a first stage of a wash cycle a single additive from removable storage tank 110 may be added. During a second stage of the wash cycle, the washing machine controller may add a second additive from removable storage tank 112. For example, during a first cycle, the items in the washing machine may be washed using laundry detergent. During the second stage of the wash cycle, a fabric softener may be added. Other examples may include, adding a rinsing agent, or predetermined amounts of additives base on the laundry load size, etc. In addition, the washing machine controller may be configured to facilitate the delivery of a continuous amount of additive to the washing machine while the user continuously depresses a button.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An appliance configured to include removable storage tanks, the appliance comprising at least:

a sensor housing;

a first storage container operatively connected to a first pump within a pedestal drawer positioned beneath the appliance, wherein the first storage container comprises an opening for allowing the sensor housing to attach to the first storage container, the first storage container being configured:

for insertion into a predetermined position within the appliance without the use of tools; and to house a large amount of a first additive;

one pump connected to at least one valve, wherein the at least one valve is positioned at a first opening of the first storage container, wherein the pump facilitates flow of the first additive from the first storage container into the appliance; and a controller operatively connected to the pump, wherein the controller is programmed to pump a defined amount of the first additive from the first storage container at a defined time interval.

2. The appliance of claim 1, further comprising a second storage container, wherein the second storage container is operatively connected to a second pump.

3. The appliance of claim 1, wherein the first storage container includes a sensor operatively connected to the controller and configured to transmit data representative additive level within the first storage container to the controller, wherein the controller is operatively connected to a display panel and facilitates additive level within the first storage container on the display panel.

4. The appliance of claim 1 including a pan, wherein the pan is configured to allow the first container to be positioned within the pedestal drawer in a predetermined orientation.

5. The appliance of claim 1 including a cover that is pivotally attached and configured to allow access to the first container.

6. The appliance of claim 1, wherein the first storage container is disposable.

7. The appliance of claim 1, including a sensor for use in association with the first storage container, wherein the sensor is operatively connected to the controller and configured to indicate an amount of the first additive within the first storage container.

8. The appliance of claim 7, wherein the sensor is removable from the first storage container.

9. The appliance of claim 1, further comprising a second storage container, wherein the first and second storage containers are keyed to at least one of the pedestal drawer and to each other.

10. The appliance of claim 9, wherein keying the first and second storage containers to the appliance comprises the first and second storage containers being differing shapes such that the differing shapes designate a particular location for each of the first and second storage containers within the pedestal drawer and wherein a sidewall of the first container is keyed to mate with a sidewall of the second container, thereby facilitating a keyed connection when the first and second storage containers are positioned adjacently in the pedestal drawer.

* * * * *